US009325045B2

(12) United States Patent
Shiokawa et al.

(10) Patent No.: US 9,325,045 B2
(45) Date of Patent: Apr. 26, 2016

(54) FILTER AND RESONATOR

(71) Applicant: Kabushiki Kaisha Toshiba, Minato-ku (JP)

(72) Inventors: Noritsugu Shiokawa, Kanagawa (JP); Hiroyuki Kayano, Kanagawa (JP); Tamio Kawaguchi, Kanagawa (JP); Kohei Nakayama, Kanagawa (JP)

(73) Assignee: Kabushiki Kaisha Toshiba, Minato-ku (TW)

( * ) Notice: Subject to any disclaimer, the term of this patent is extended or adjusted under 35 U.S.C. 154(b) by 134 days.

(21) Appl. No.: 14/205,821

(22) Filed: Mar. 12, 2014

(65) Prior Publication Data

US 2014/0327500 A1 Nov. 6, 2014

(30) Foreign Application Priority Data

Apr. 12, 2013 (JP) ..... 2013-084148

(51) Int. Cl.

| | |
|---|---|
| ***H01P 1/205*** | (2006.01) |
| ***H01P 3/08*** | (2006.01) |
| ***H01P 1/203*** | (2006.01) |
| ***H01P 7/08*** | (2006.01) |

(52) U.S. Cl.

CPC ..... *H01P 1/205* (2013.01); *H01P 1/20336* (2013.01); *H01P 1/20372* (2013.01); *H01P 7/082* (2013.01)

(58) Field of Classification Search

CPC . H01P 1/20372; H01P 7/082; H01P 1/20336; H03H 7/0115; H03H 7/1766

USPC ..... 333/204

See application file for complete search history.

(56) References Cited

U.S. PATENT DOCUMENTS 5,055,809 A * 10/1991 Sagawa ..... H01P 1/20336 333/204

6,529,750 B1 * 3/2003 Zhang ..... H01P 1/20336 333/185

(Continued)

FOREIGN PATENT DOCUMENTS

| | | |
|---|---|---|
| JP | 60-185402 A | 9/1985 |
| JP | 2007-104070 | 4/2007 |
| JP | 2007-195116 | 8/2007 |

OTHER PUBLICATIONS

Extended European Search Report issued Sep. 5, 2014 in Patent Application No. 14156666.1.

*Primary Examiner* — Robert Pascal
*Assistant Examiner* — Kimberly Glenn
(74) *Attorney, Agent, or Firm* — Oblon, McClelland, Maier & Neustadt, L.L.P.

(57) ABSTRACT

A filter according to embodiments includes n resonators, an input line, and an output line. Each of the resonators includes a first comb-like structure, a second comb-like structure, and a connection line that connect the first and the second comb-like structure. The first and second comb-like structures have a plurality of first lines and a second line that is connected to one end of the first lines. The first lines of the first and the second comb-like structures are arranged parallel to each other. The connection line has bending portions. Further, a second comb-like structure of a k-th resonator and a first comb-like structure of a (k+1)-th resonator are arranged so as to have an interlaced arrangement, and a second comb-like structure of the (k+1)-th resonator and a first comb-like structure of a (k+2)-th resonator are arranged so as to have an interlaced arrangement.

19 Claims, 12 Drawing Sheets

(56) References Cited

U.S. PATENT DOCUMENTS 7,071,797 B2 * 7/2006 Ye ..... H03H 2/00 333/202
7,098,759 B2 * 8/2006 Chang ..... H01P 1/212 333/185
7,181,259 B2 * 2/2007 Tsuzuki ..... H01P 1/20336 333/204
7,215,225 B2 * 5/2007 Fuke ..... H01P 1/20381 333/204
7,437,187 B1 * 10/2008 Ye ..... H01P 1/20336 333/185
7,495,531 B2 2/2009 Kayano
2005/0003792 A1 1/2005 Aiga et al.
2007/0171004 A1 7/2007 Kayano
2010/0079221 A1 4/2010 Shiokawa et al.

* cited by examiner

FIG.3A
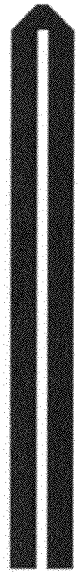
FIG.3B
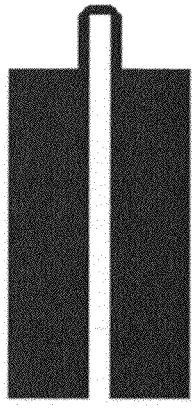
FIG.3C
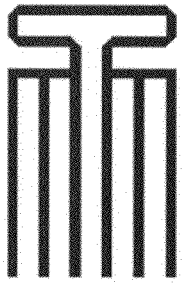
FIG.3D
FIG.4
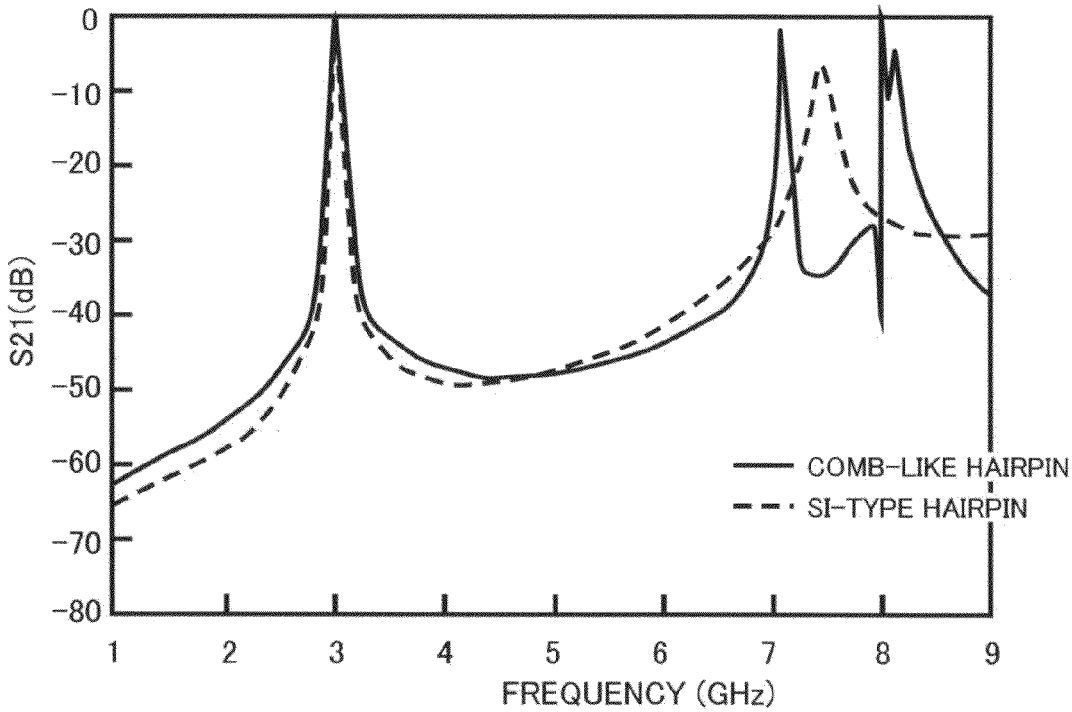

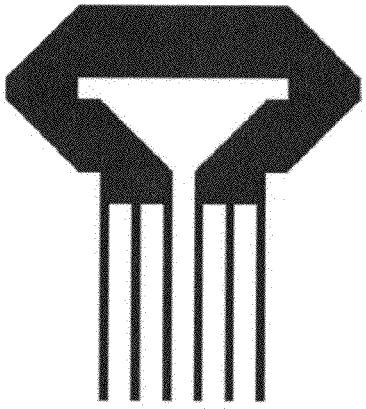
FIG.5A
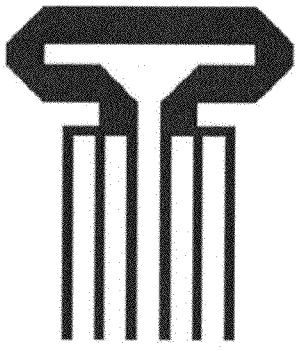
FIG.5B
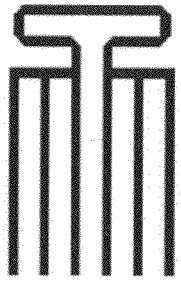
FIG.5C
FIG.6
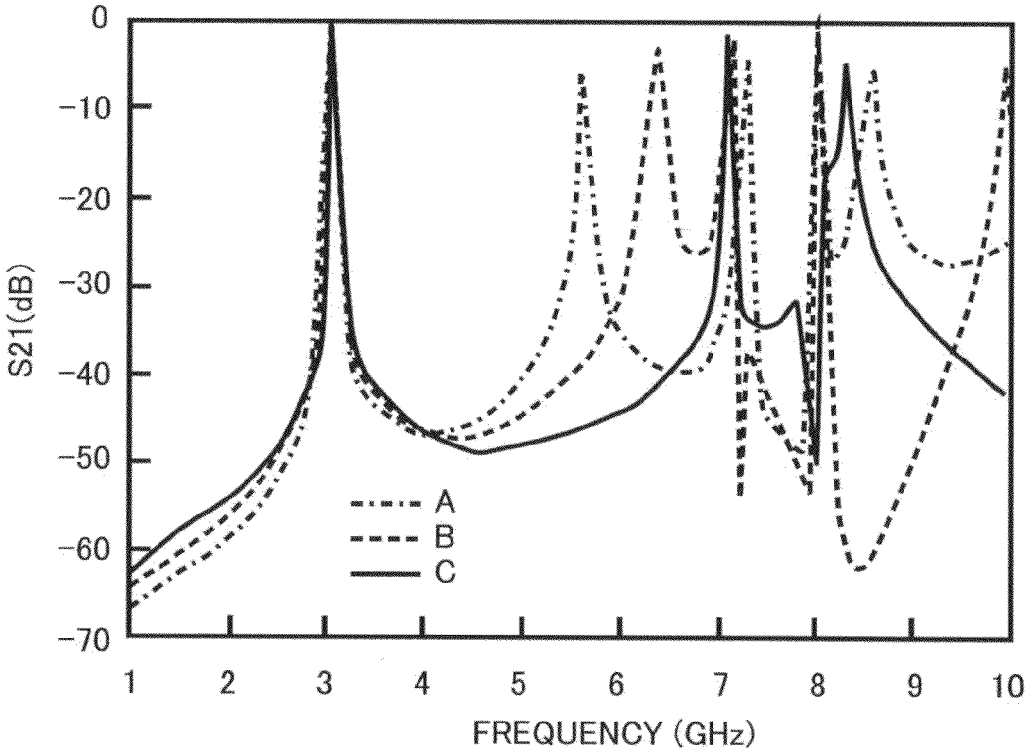

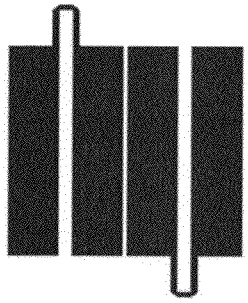
FIG.7A
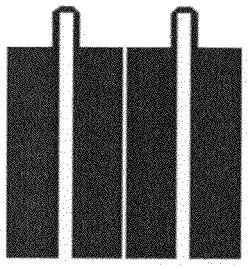
FIG.7B
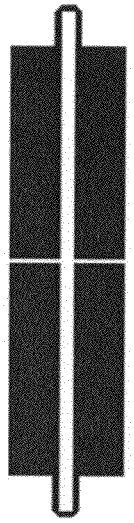
FIG.7C
FIG.8
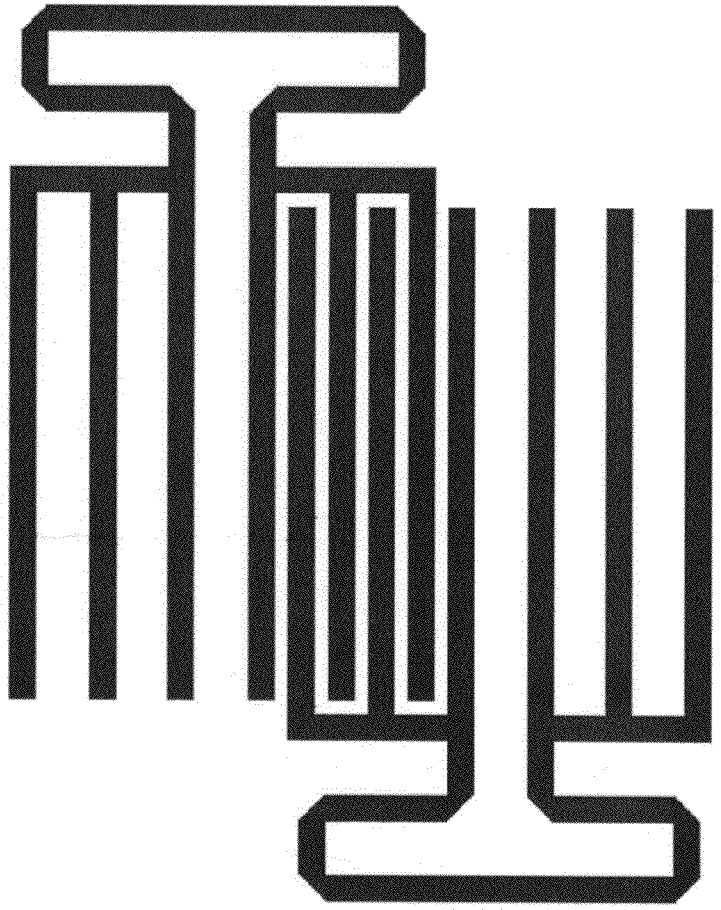

FILTER AND RESONATOR

CROSS-REFERENCE TO RELATED APPLICATION

This application is based upon and claims the benefit of priority from Japanese Patent Application No. 2013-084148, filed on Apr. 12, 2013, the entire contents of which are incorporated herein by reference.

FIELD

Embodiments described herein relate generally to a filter and a resonator.

BACKGROUND

In a case of forming a superconducting band-pass filter having a microstrip line structure, it is preferable that resonators constituting a filter be a low loss and that a spurious frequency component, which is not intended in design, is suppressed. Particularly, in a case of forming a broadband band-pass filter, a strong coupling between the resonators constituting the filter is required.

An unloaded Q value Qu of the resonator is expressed as follows using a Q value Qc due to conductor loss, a Q value Qr due to radiation loss, and a Q value Qd due to dielectric loss:

$$1/Qu=1/Qc+1/Qr+1/Qd$$

In a case of forming the resonator of the microstrip line structure using conductor materials with low loss and a dielectric substrate with low loss, accordingly, a dominant factor that determines the unloaded Q value is the radiation loss. In order to realize the resonator with the low loss, therefore, it is important to suppress the radiation loss.

BRIEF DESCRIPTION OF THE DRAWINGS

FIGS. 3A to 3D are top views illustrating patterns of resonators used for comparison with the resonator according to the first embodiment;

FIG. 4 is a diagram illustrating a frequency characteristic of an SI-type hairpin resonator and the resonator according to the first embodiment;

FIGS. 5A to 5C are top views illustrating patterns of three resonators with different widths of connection lines;

FIG. 6 is a diagram illustrating a resonance characteristic of three resonators of FIGS. 5A to 5C;

FIGS. 7A to 7C are top views illustrating patterns in which two SI-type hairpin resonators are coupled to each other;

FIG. 8 is a diagram illustrating a pattern in which two resonators according to the first embodiment are coupled to each other in an interlaced arrangement;

DETAILED DESCRIPTION

Figure 1:
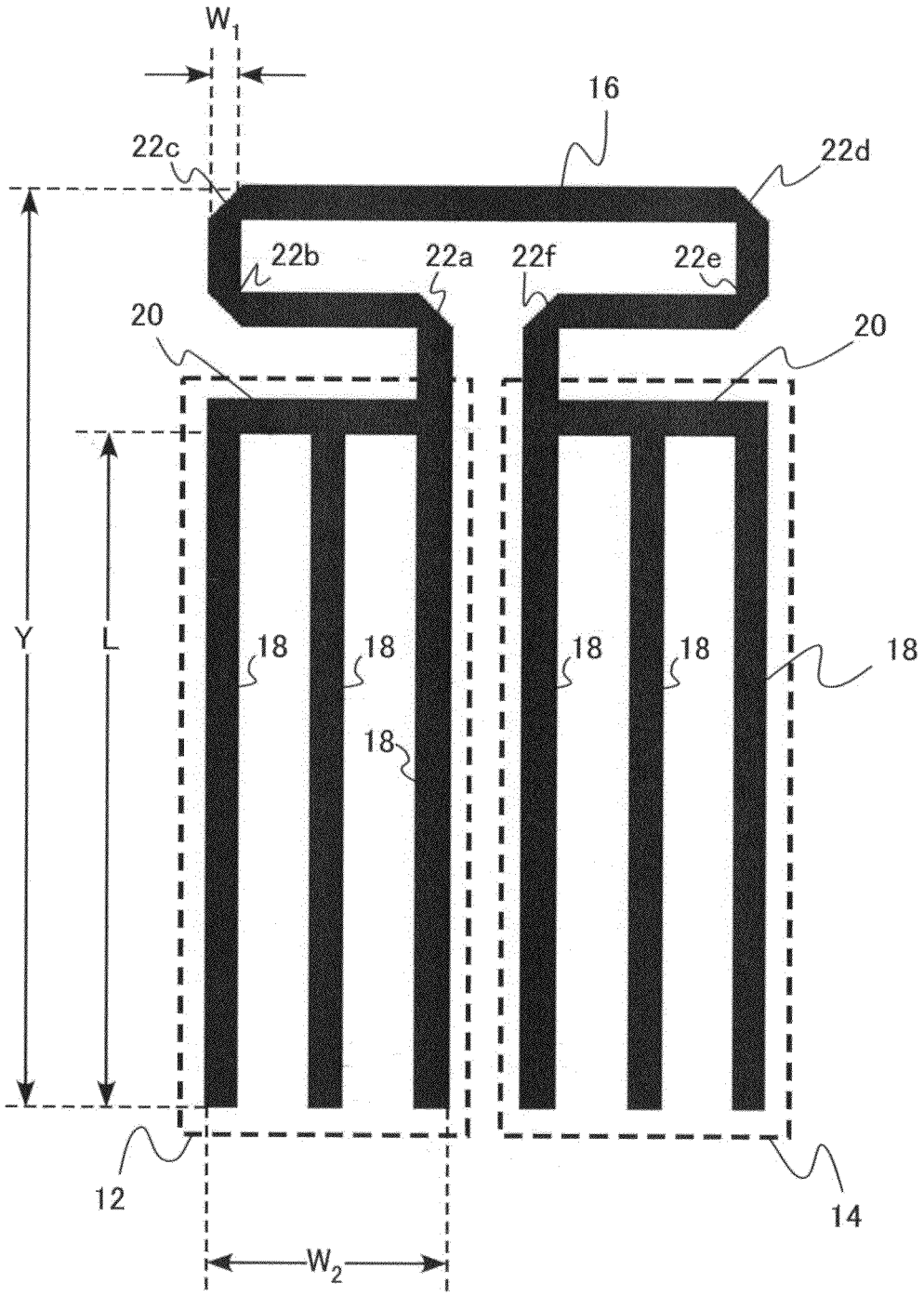
FIG. 1 is a top view illustrating a pattern of a resonator according to a first embodiment.

A filter having a microstrip line structure according to embodiments includes n (n is a natural number larger than or equal to three) resonators arranged from a first resonator to n-th resonator in ascending order, an input line coupled to the first resonator, and an output line coupled to an n-th resonator. Each of the n resonators includes a first comb-like structure, a second comb-like structure, and a connection line connecting the first comb-like structure and the second comb-like structure to each other. Each of the first and second comb-like structures having a plurality of first lines extending substantially parallel to each other and a second line connected to one ends of each of the first lines, the first lines of the first comb-like structure and the first lines of the second comb-like structure are arranged so as to be substantially parallel to each other. The connection line has bending portions, and the connection line is connected to the second line of each of the first comb-like structure and the second line of the second comb-like structure. A second comb-like structure of a k ($1 \leq k \leq n-2$)-th resonator and a first comb-like structure of a (k+1)-th resonator are arranged so as to have an interlaced arrangement, and a second comb-like structure of the (k+1)-th resonator and a first comb-like structure of a (k+2)-th resonator are arranged so as to be coupled to each other.

Embodiments will be described with reference to the drawings. Moreover, in each of the drawings, the same or similar elements will be denoted by the same reference numeral.

First Embodiment

A resonator according to the first embodiment is a resonator having a microstrip line structure and includes a first comb-like structure, a second comb-like structure, and a connection line configured to connect the first comb-like structure and the second comb-like structure to each other. Then, each of the first and second comb-like structures is made up of a plurality of first lines which extend substantially parallel to each other and a second line which is connected to one end of each of the first lines. In addition, the first and second comb-like structures are arranged such that the first lines are substantially parallel to each other in an extending direction. Moreover, the connection line has bending portions, so that the connection line is connected to each of the second lines of the first and second comb-like structures.

With this configuration, the resonator according to the first embodiment can realize a broadband band-pass filter with low loss.

FIG. 1 is a top view illustrating a pattern of the resonator according to the first embodiment. The resonator pattern illustrated in FIG. 1 is formed using conductor materials on a dielectric substrate which is provided with a ground plane at a lower surface. The resonator according to the first embodiment is a resonator having the so-called microstrip line structure.

Preferably, the conductor material is a thin film of a superconducting material. The superconducting material is, for example, YBCO (yttrium-based superconductor).

The resonator pattern according to the first embodiment includes a first comb-like structure 12, a second comb-like structure 14, and a connection line 16 configured to connect the first comb-like structure 12 and the second comb-like structure 14 to each other. Each of the first comb-like structure 12 and the second comb-like structure 14 is made up of three first lines 18 which extend substantially parallel to each other and a second line 20 which is connected to one end of each of the first lines 18.

Then, each of the first and second comb-like structures 12 and 14 is arranged such that the first lines 18 thereof are substantially parallel to each other. In other words, the first and second comb-like structures 12 and 14 are arranged such that all of the first lines 18 extend in the same direction.

Further, the connection line 16 includes six bending portions 22*a* to 22*f*. Then, the connection line 16 is connected to each of the second lines 20 of the first and second comb-like structures 12 and 14. That is, the second line 20 of the first comb-like structure 12 is connected to the second line 20 of the second comb-like structure 14 through the connection line 16.

Since the connection line 16 includes six bending portions 22*a* to 22*f*, a length in the extending direction of the first lines 18 of the resonator pattern is shortened, and thus miniaturization of the resonator pattern is realized. Further, more bending portions may be provided in the connection line 16. Alternatively, when the miniaturization is not required, the connection line 16 may be formed in a simple folding pattern having two bending portions.

The resonator pattern according to the first embodiment is a hairpin type in which both ends are provided with the comb-like structure as described above. Hereinafter, this resonator is referred to as a comb-like hairpin resonator.

Furthermore, in FIG. 1, a physical length of the first lines 18 is indicated by "L", and a physical length in the extending direction of the first line 18 of the resonator is indicated by "Y". In addition, a width of the connection line 16 is indicated by "$W_1$", and a width in a direction vertical to the extending direction of the first lines 18 of each of the first and second comb-like structures 12 and 14 is indicated by "$W_2$".

Figure 2:
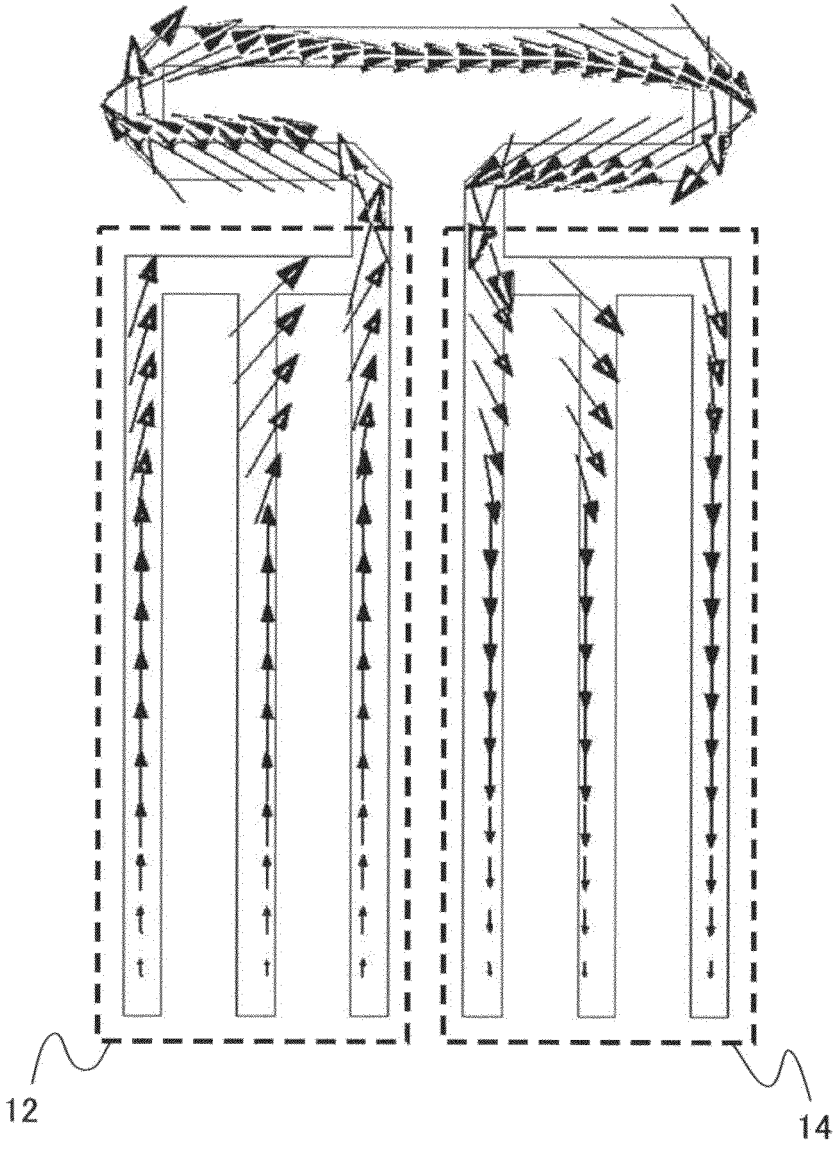
FIG. 2 is a diagram illustrating a current distribution of the resonator of the first embodiment.

FIG. 2 is a diagram illustrating a current distribution of the resonator according to the first embodiment. FIG. 2 illustrates results obtained by calculating the current distribution in the resonator using a two-dimensional electromagnetic field simulator when the resonator illustrated in FIG. 1 generates a half-wavelength resonance. In FIG. 2, arrow directions indicate a current direction, and an arrow length indicates a magnitude of current.

As can be seen from FIG. 2, the current distribution of the first comb-like structure 12 and the current distribution of the second comb-like structure 14 have an opposite phase. Accordingly, radiation magnetic fields of the first comb-like structure 12 and the second comb-like structure 14 are canceled from each other. Therefore, radiation loss is suppressed in the resonator according to the first embodiment.

Through the electromagnetic field simulation, the resonator of FIG. 1 is compared with other types of resonators, and thus the effect is verified. FIGS. 3A to 3D are top views illustrating patterns of resonators used for comparison with the resonator according to the first embodiment. Hereinafter, the resonators illustrated in FIGS. 3A to 3C are referred to as a straight-line resonator, a simple hairpin resonator, and a step impedance (SI)-type hairpin resonator, respectively. FIG. 3D illustrates the comb-like hairpin resonator according to the first embodiment.

In the above simulation, a resonant frequency of a fundamental (half-wavelength resonance) is set to 3.0 GHz in all of the resonators. In addition, the loss of the dielectric substrate is ignored, and electric conductivity "σ" of a conductor is calculated using the equation of σ=1.8 E+13.

First, Q values of the resonators are compared with each other to confirm the suppression effect of the radiation loss. In the straight-line resonator, unloaded Q value (Qu) is 3,500, a Q value due to the radiation loss (Qr) is 3,600, and a Q value due to conductor loss (Qc) is 140,000. In this resonator, the Qr is dominant, and it is necessary to improve the Qr in order to improve the Qu. In order to improve the Qr, it is necessary to form the resonator shape to cancel the radiation. Among such resonators, the simple hairpin resonator is one of those having a simple shape.

In the simple hairpin resonator, the Qu is 62000, the Qr is 1070000, and the Qc is 66000. Further, in order to avoid the influence of a second harmonic to be described below, it is considered to use the SI-type hairpin resonator. In the SI-type hairpin resonator, the Qu is 36000, the Qr is 93000, and the Qc is 61000. Both in the case of the simple hairpin resonator and the SI-type hairpin resonator, the Qr is high and the radiation is suppressed compared with those in the straight-line resonator.

In comparison with these resonators, the comb-like hairpin resonator according to the first embodiment has the Qu of 39000, the Qr of 153000, and Qc of 52000. This resonator can also suppress the radiation to realize the unloaded Q value which is higher than that of the SI-type hairpin resonator.

Generally, as the frequency of the second harmonic of the resonator is close to the frequency of the fundamental, a spurious problem is occurred in some cases. Here, in each of the resonators, the frequency of the second harmonic is compared with each other.

In comparison with the frequency 3.0 GHz of the fundamental resonance, the frequency of the second harmonic resonance is 5.2 GHz in the simple hairpin resonator and is 7.4 GHz in the SI-type hairpin resonator. The SI-type hairpin resonator is formed such that tips of two lines constituting the hairpin have a structure of a patch shape, and thus the frequency of the second harmonic resonance is equal to or more than double of the frequency of the fundamental resonance.

FIG. 4 is a diagram illustrating a frequency characteristic of the SI-type hairpin resonator and the resonator according to the first embodiment. As in the SI-type hairpin resonator, in the comb-like hairpin resonator according to the first embodiment, the frequency of the second harmonic resonance is also equal to or more than double of the frequency of the fundamental resonance, that is, 6 GHz or more. Accordingly, the spurious problem is hard to occur.

Further, in this example, the line width $W_1$ of the connection line 16 is narrower than the width $W_2$ in the direction vertical to the extending direction of the first lines 18 of the first and second comb-like structures 12 and 14.

It is possible to shift the frequency of the second harmonic resonance to higher frequency region by narrowing the line width $W_1$ of the connection line.

FIGS. 5A to 5C are top views illustrating patterns of three resonators with different widths of connection lines. FIG. 5A illustrates a resonator pattern in a case where the line width $W_1$ of the connection line is the same as the width $W_2$ of the comb-like structure. FIG. 5B illustrates a resonator pattern in a case where the line width $W_1$ of the connection line is ½ of the width $W_2$ of the comb-like structure. FIG. 5C illustrates a resonator pattern in a case where the line width $W_1$ of the connection line is ⅐ of the width $W_2$ of the comb-like structure. The resonator pattern of the FIG. 5C is of the first embodiment.

FIG. 6 is a diagram illustrating a resonance characteristic of three resonators of FIGS. 5A to 5C. An alternate long and short dashed line A of FIG. 6 corresponds to FIG. 5A, a dotted line B of FIG. 6 corresponds to FIG. 5B, and a solid line C of FIG. 6 corresponds to FIG. 5C.

The fundamental frequency of the resonator is 3 GHz even in any case. However, as the second harmonic frequency is higher, the line width $W_1$ of the connection line becomes narrower. The second harmonic frequency is lower than a double of the fundamental frequency (6 GHz) when the line width $W_1$ of the connection line is the same as the width $W_2$ of the comb-like structure, and the second harmonic frequency is higher than a double of the fundamental frequency when the line width $W_1$ of the connection line is narrower than the width $W_2$ of the comb-like structure.

Therefore, it is preferable that the line width $W_1$ of the connection line 16 be narrower than the width $W_2$ in the direction vertical to the extending direction of the first lines 18 of each of the first and second comb-like structures 12 and 14, from the viewpoint of suppressing the spurious.

Using the resonator according to the first embodiment, a case of configuring a band-pass filter having, for example, a band width of 700 MHz is considered. In this case, a required coupling coefficient between the resonators is up to about 0.2. The coupling coefficient between the resonators, which is required to configure the filter, increases as the bandwidth of the filter broadens.

FIGS. 7A to 7C are top views illustrating patterns in which two SI-type hairpin resonators are coupled to each other. When the SI-type hairpin resonators are close to each other at the interval of 0.1 mm in a horizontal direction (anti-parallel) as illustrated in FIG. 7A, in a horizontal direction (parallel) as illustrated in FIG. 7B, and in a longitudinal direction as illustrated in FIG. 7C, the coupling coefficient is 0.08, 0.042, and 0.043, respectively, but does not reach 0.2 of the required coupling coefficient even in any cases. The coupling coefficient increases as the interval between the resonators becomes closer. However, since there is a problem on producing the filter in that a product yield of a patterning process is deteriorated when the interval between the resonators is closer than 0.1 mm, the interval between the resonators is set to be 0.1 mm in the first embodiment.

FIG. 8 is a diagram illustrating a pattern in which two resonators according to the first embodiment are coupled to each other in an interlaced arrangement. When two resonators are arranged at the interval of 0.1 mm in the interlaced arrangement, the coupling coefficient is 0.26 which is a value exceeding 0.2 as the required coupling coefficient.

According to the resonator of the first embodiment, it is possible to realize the broadband band-pass filter by increasing the coupling coefficient between the resonators while implementing the sufficient unloaded Q value and the characteristic of second harmonic. Furthermore, the above-described numerical examples are only an example and are not intended to limit the scope of the first embodiment.

Second Embodiment

A filter according to a second embodiment is a filter having a microstrip line structure which includes n (n is a natural number larger than or equal to three) resonators arranged from a first resonator to n-th resonator in ascending order, an input line that is coupled to a first resonator, and an output line that is coupled to an n-th resonator. In the filter, each of the resonators includes a first comb-like structure, a second comb-like structure, and a connection line that is configured to connect the first comb-like structure and the second comb-like structure to each other. Each of the first and second comb-like structures is made up of a plurality of first lines that extend substantially parallel to each other and a second line that is connected to one end of each of the first lines. The first lines of the first comb-like structure and the first lines of the second comb-like structure are arranged so as to be substantially parallel to each other in an extending direction. And the connection line has bending portions such that the connection line is connected to the second line of each of the first comb-like structure and the second comb-like structure. Then, a second comb-like structure of a k ($1 \le k \le n-2$)-th resonator and a first comb-like structure of a (k+1)-th resonator are arranged so as to have an interlaced arrangement, and a second comb-like structure of the (k+1)-th resonator and a first comb-like structure of a (k+2)-th resonator are arranged so as to have an interlaced arrangement. The filter according to the second embodiment is a filter that is formed by coupling the plurality of resonators according to the first embodiment to each other. Hereinafter, the description of the same contents as the first embodiment will be avoided.

Figure 9:
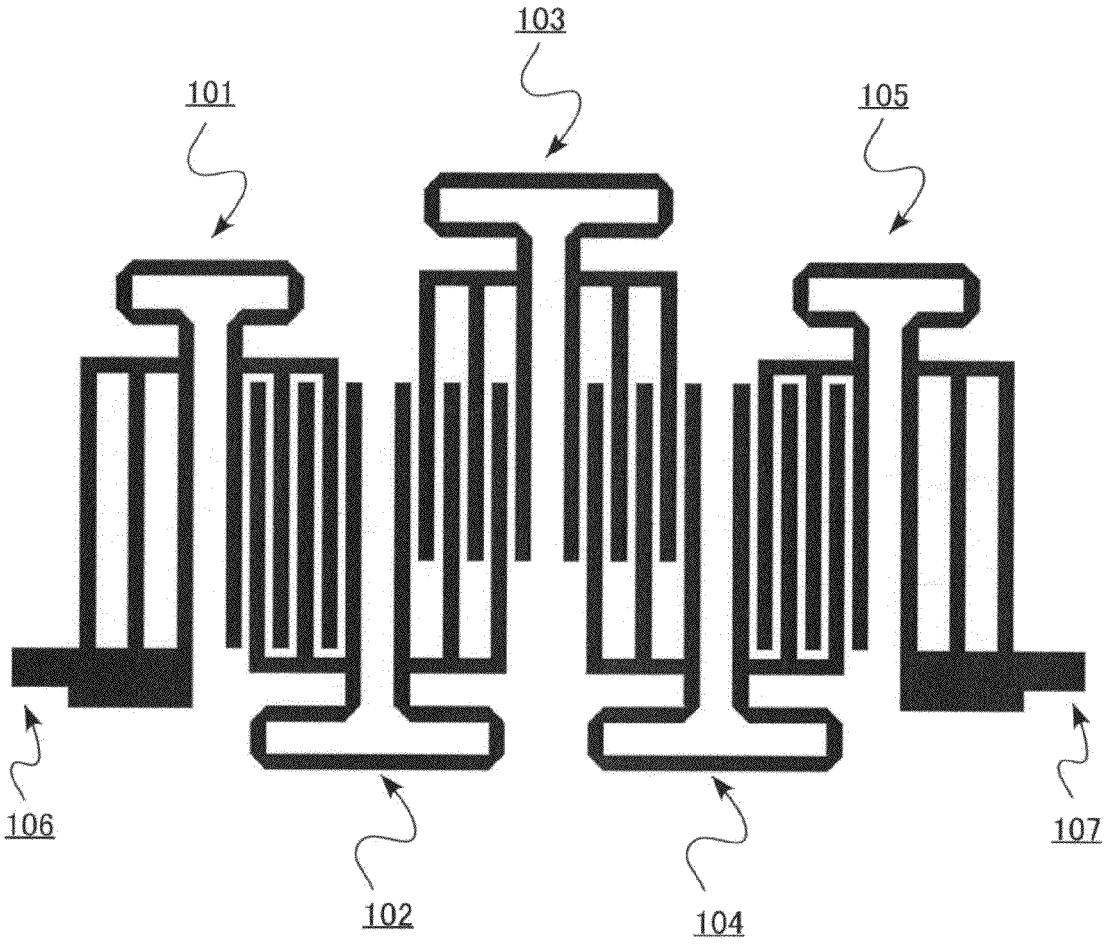
FIG. 9 is a top view illustrating a pattern of a filter according to a second embodiment.

FIG. 9 is a top view illustrating a pattern of a filter according to the second embodiment. The filter pattern illustrated in FIG. 9 is formed using conductor materials on a dielectric substrate which is provided with a ground plane at a lower surface. The filter according to the second embodiment is a filter having a so-called microstrip line structure.

The filter according to the second embodiment includes five resonators a first resonator 101, a second resonator 102, a third resonator 103, fourth resonator 104, and fifth resonator 105 having the microstrip line structure, an input line 106 coupled to the first resonator 101, and an output line 107 coupled to the fifth resonator 105. The filter according to the second embodiment is a fifth-order Chebyshev filter.

As described in the first embodiment, each of five resonators 101, 102, 103, 104, and 105 includes the first comb-like structure, the second comb-like structure, and the connection line configured to connect the first comb-like structure and the second comb-like structure to each other. Then, the first and second comb-like structures are made up of the plurality of first lines which extend substantially parallel to each other and the second line which is connected to one end of each of the first lines. In addition, the first and second comb-like structures are arranged such that the first lines are substantially parallel to each other in an extending direction. Moreover, the connection line has bending portions, so that the connection line is connected to each of the second lines of the first and second comb-like structures.

For convenience, one of two comb-like structures in one resonator, for example, the comb-like structure close to the input line 106 is referred to as a first comb-like structure, and the other of two comb-like structures in one resonator, for example, the comb-like structure close to the output line is referred to as a second comb-like structure.

In addition, a second comb-like structure of a k ($1 \le k \le 3$)-th resonator and a first comb-like structure of a (k+1)-th resonator are arranged so as to have an interlaced arrangement, and a second comb-like structure of the (k+1)-th resonator and a first comb-like structure of a (k+2)-th resonator are arranged so as to have an interlaced arrangement. Specifically, for example, the second comb-like structure of the first resonator 101 and the first comb-like structure of the second resonator 102 are arranged so as to have an interlaced arrangement, and the second comb-like structure of the second resonator 102 and the first comb-like structure of the third resonator 103 are arranged so as to have an interlaced arrangement. The interlaced arrangement means the structure in which the first lines of the second comb-like structure of the (k+1)-th resonator and the first lines of the first comb-like structure of the (k+2)-th resonator are alternatively placed facing to each other. In the structure, at least one of first lines of the second comb-like structure of the (k+1)-th resonator is placed in-between the first lines of the first comb-like structure of the (k+2)-th resonator and at least one of first lines of the first comb-like structure of the (k+2)-th resonator is placed in-between the first lines of the second comb-like structure of the (k+1)-th resonator.

In this manner, the interlaced arrangement is formed between the comb-like structures of five resonators 101, 102, 103, 104, and 105, so that the required coupling coefficient between the resonators can be achieved. A desired coupling coefficient can be achieved by varying an overlapping length of the first lines in the interlaced arrangement.

In the structure of the interlaced arrangement, when the number of first lines of any one of the first and second comb-like structures, the physical length of the first lines, and the physical length in the extending direction of the first lines of the resonator are m (m is a natural number of two or more), L, and Y, respectively, it is preferred to satisfy the relation of $(2m-1)\times L \geq Y$. The reason is because a facing region between the resonators is increased compared with a case where two resonators are not arranged in the interlaced arrangement but in a horizontal row as this relation is satisfied, and thus the coupling coefficient between the resonators becomes larger.

Figure 10A:
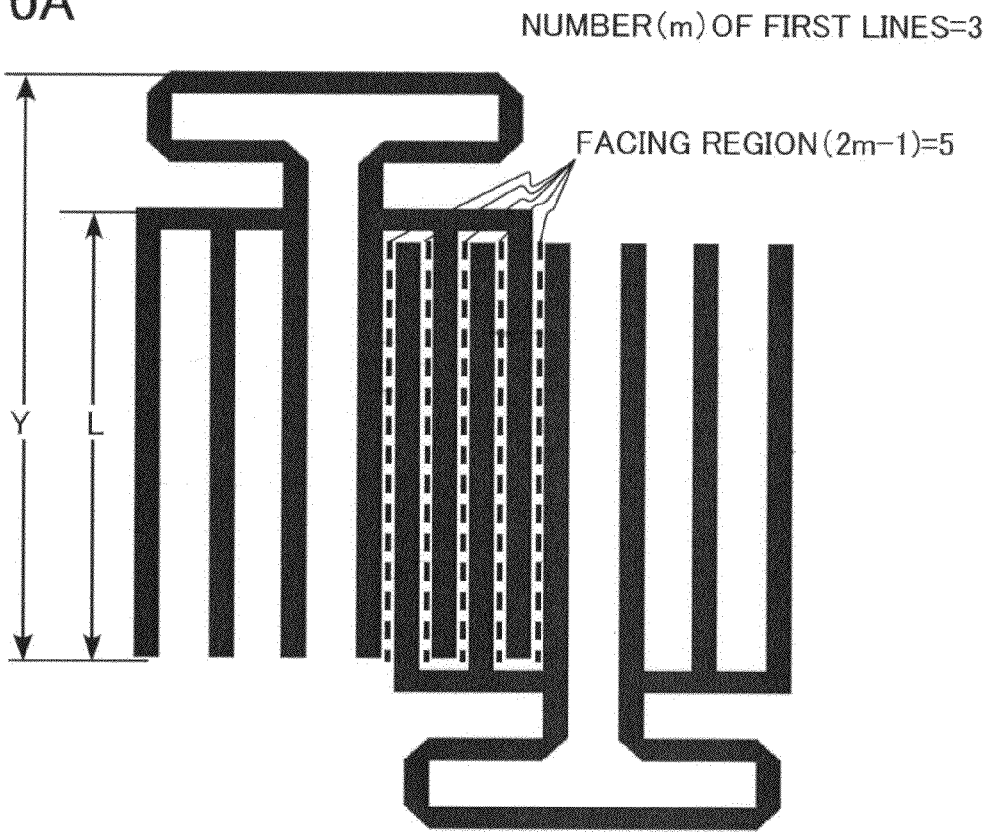
FIGS. 10A and 10B are explanatory diagrams of an operation of the filter according to the second embodiment.
Figure 10B:
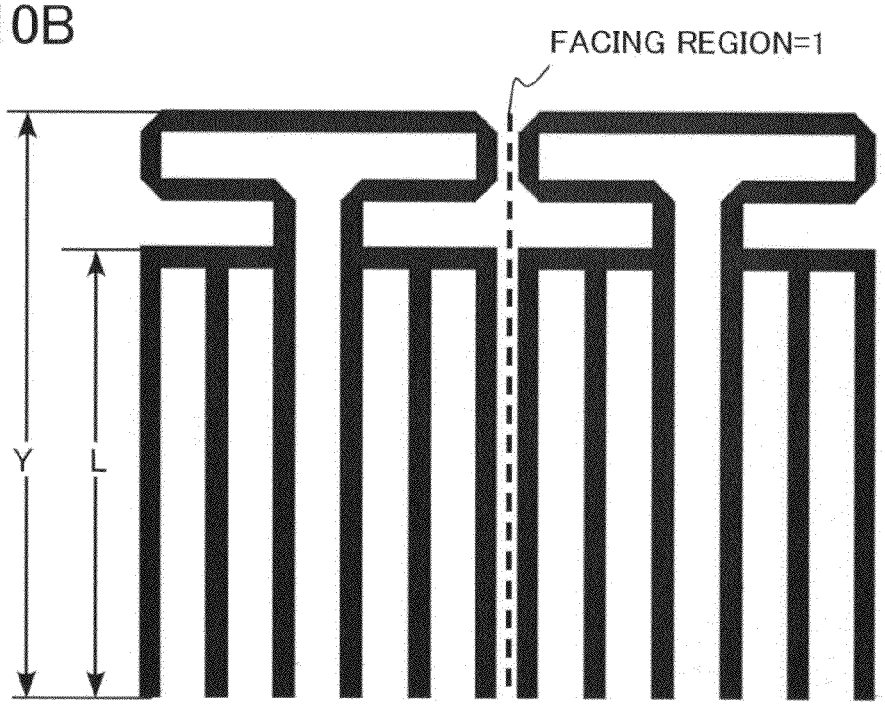

FIGS. 10A and 10B are explanatory diagrams of an operation of the filter according to the second embodiment. FIG. 10A illustrates a case where two resonators has the structure of the interlaced arrangement, and FIG. 10B illustrates a case where two resonators are arranged in a horizontal row. In FIGS. 10A and 10B, the number of first lines (m) is 3. In the case of the structure of the interlaced arrangement, the number of facing regions (2m−1) between the resonators, which are indicated by a dashed-line in FIG. 10A, is 5. Therefore, a length of the facing regions is "5×L". On the other hand, in the case of the horizontal row arrangement, a length of the facing region between the resonators, which is indicated by a dashed-line in FIG. 10B, is Y. Accordingly, when the relation of $5\times L \geq Y$ is satisfied, the structure of the interlaced arrangement of the resonators has a larger coupling coefficient between the resonators than the horizontal row arrangement of the resonators.

In addition, the input line 106 is directly connected to an open end of the first comb-like structure of the first resonator 101, and the output line 107 is directly connected to an open end of the second comb-like structure of the fifth resonator 105. In this manner, the input/output lines are directly connected to the resonators, so that a large coupling coefficient between the resonators and an external circuit (reciprocal of external Q) can be achieved and the broadband filter can be attained.

Moreover, the filter is formed such that a line width of the input line 106 is changed in the vicinity of a connection portion with the first comb-like structure of the first resonator 101 and a line width of the output line 107 is changed in the vicinity of a connection portion with the second comb-like structure of the fifth resonator 105. The connection portions of the input and output are provided with a so-called stub structure. By this structure, impedance matching between the resonator and the input/output lines is adjusted, and the coupling coefficient between the resonators and the external circuit (reciprocal of external Q) is adjusted so as to become a desired value.

According to the filter of the second embodiment, it is possible to realize the broadband band-pass filter by increasing the coupling coefficient between the resonators while implementing the sufficient unloaded Q value and the characteristic of second harmonic.

Third Embodiment

A filter according to a third embodiment is the same as the second embodiment except that the tips of the input line and the output line have a comb-like structure and form an interlaced arrangement with the first or second comb-like structure of a resonator constituting the filter. Accordingly, the description of the same contents as the second embodiment will be avoided.

Figure 11:
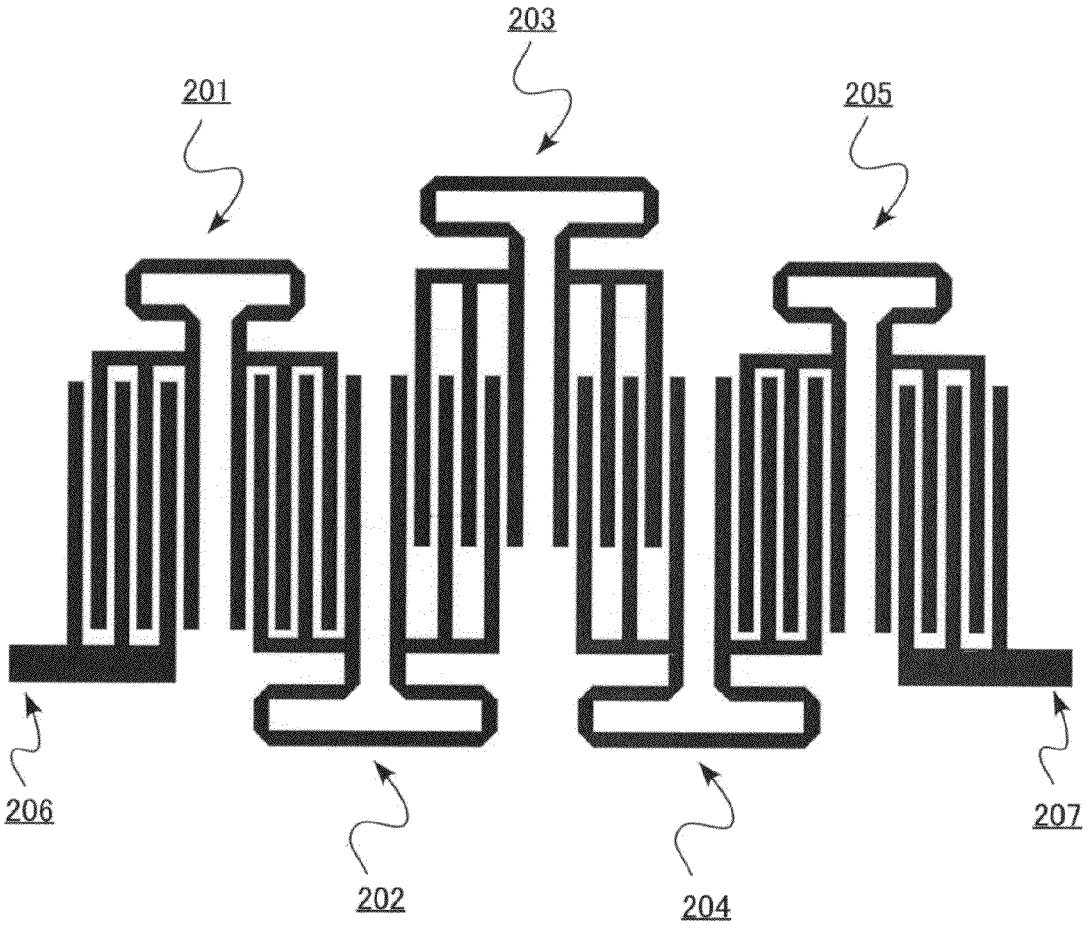
FIG. 11 is a top view illustrating a pattern of a filter according to a third embodiment.

FIG. 11 is a top view illustrating a pattern of a filter according to the third embodiment. The filter according to the third embodiment includes five resonators 201, 202, 203, 204, and 205 having the microstrip line structure, an input line 206 coupled to the first resonator 201, and an output line 207 coupled to the fifth resonator 205. The filter according to the third embodiment is a fifth-order Chebyshev filter.

The tips of the input line 206 and output line 207 have a comb-like structure. The first comb-like structure of the first resonator 201 and the comb-like structure of the input line 206 are formed in an interlaced arrangement. In addition, the second comb-like structure of the fifth resonator 205 and the comb-like structure of the output line 207 are formed in an interlaced arrangement.

According to the third embodiment, it is possible to obtain a strong coupling between the input/output lines and the resonator and to cut a DC component of a signal propagating through the filter, thereby increasing an attenuation of a low-frequency region of the filter.

Fourth Embodiment

Figure 12:
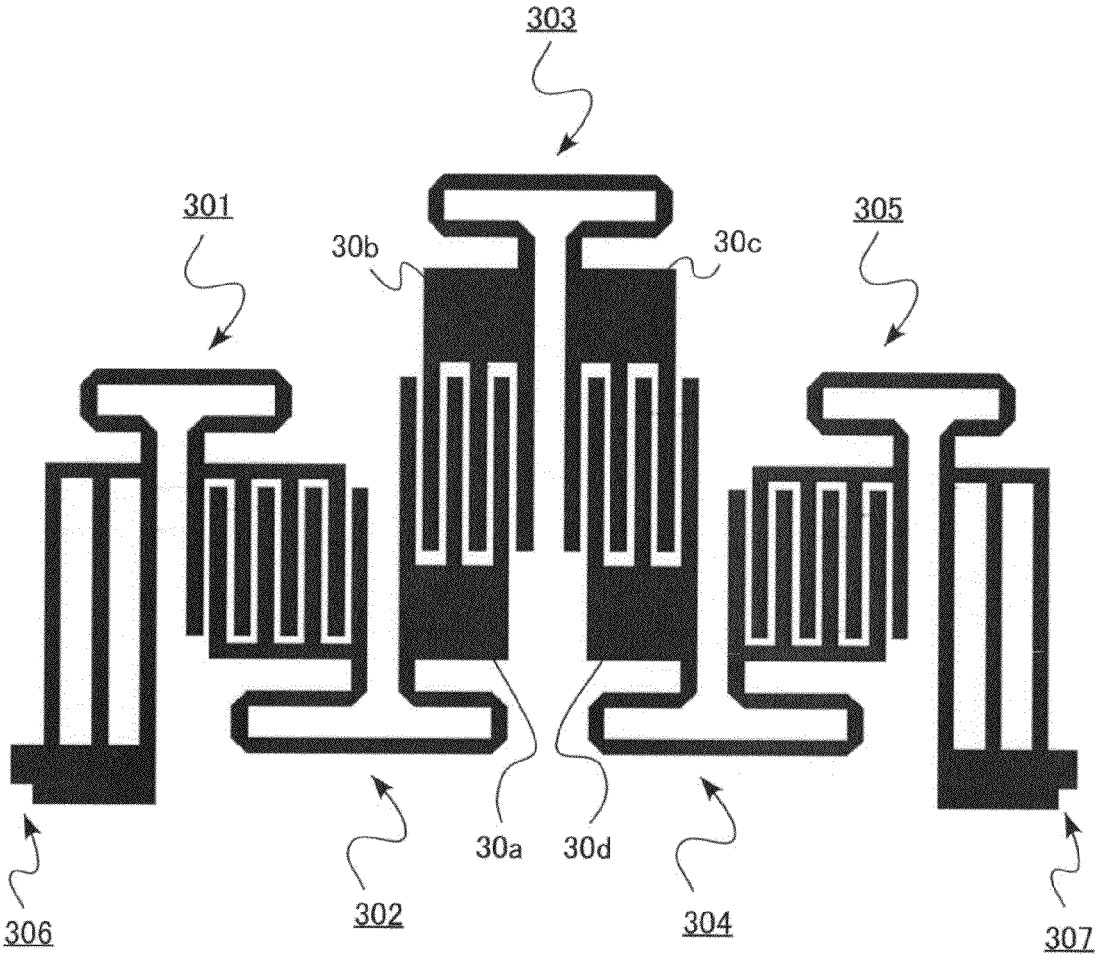
FIG. 12 is a top view illustrating a pattern of a filter according to a fourth embodiment.

The filter according to a fourth embodiment is the same as the first embodiment except that it is configured such that the resonant frequency of the first or second comb-like structure of at least one of the resonators constituting the filter is higher than the frequency of the second harmonic of the resonator. Accordingly, the description of the same contents as the first embodiment will be avoided FIG. 12 is a top view illustrating a pattern of a filter according to the fourth embodiment. The filter according to the fourth embodiment includes five resonators 301, 302, 303, 304, and 305 having a microstrip line structure, an input line 306 coupled to the first resonator 301, and an output line 307 coupled to the fifth resonator 305. The filter according to the fourth embodiment is a fifth-order Chebyshev filter.

Figure 13:
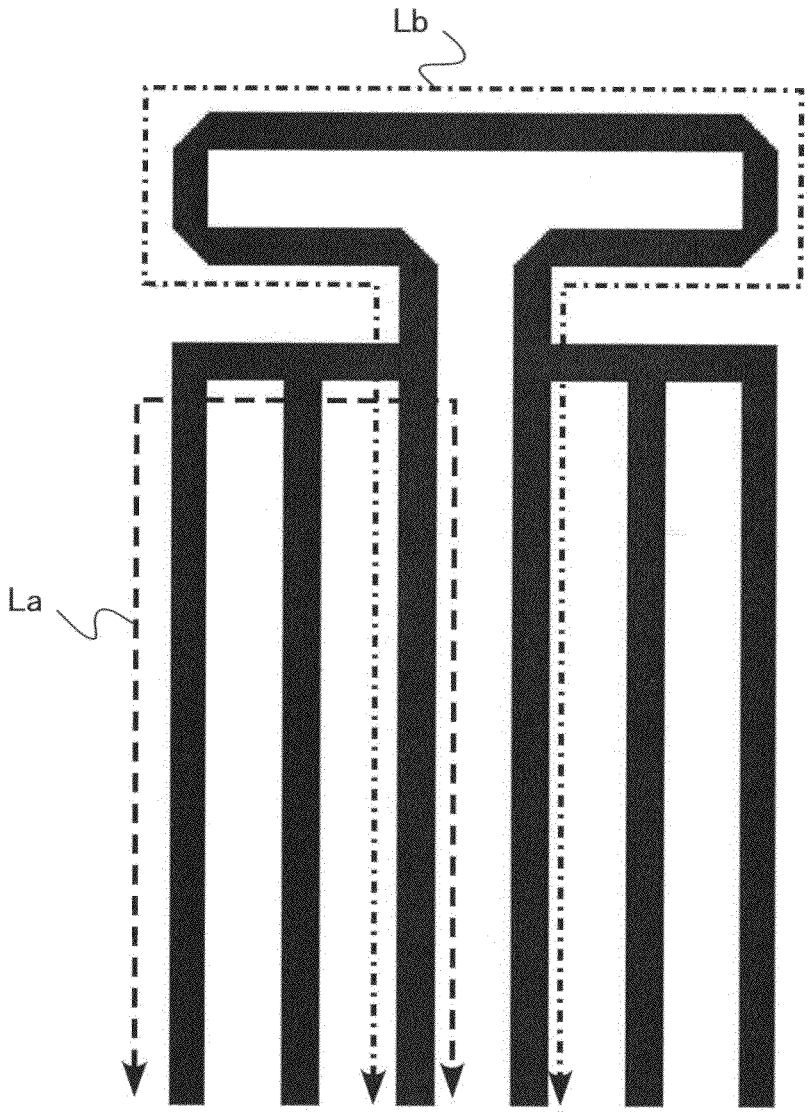
FIG. 13 is an explanatory diagram of an operation of the filter according to the fourth embodiment.

FIG. 13 is an explanatory diagram of an operation of the filter according to the fourth embodiment. The filter according to the fourth embodiment is configured such that the resonant frequency of the first or second comb-like structure of the resonator constituting the filter is higher than the frequency of the second harmonic of the resonator. Specifically, the filter is formed such that an electric length La (dotted line) of the first and second comb-like structures of the resonator constituting the filter is equal to or less than a half of an electric length Lb (dashed line) of the entire resonator.

In FIG. 12, the width of the second line in each of the second comb-like structure of the second resonator 302, the first and second comb-like structures of the third resonator 303, and the first com-like structure of the fourth resonator 304 is broader. That is, since patch units 30*a* to 30*d* having no first lines are provided in the comb-like structure, it is possible to realize the same coupling coefficient as the coupling coefficient of the filter of FIG. 9 and to satisfy the above relation. Furthermore, since the length of the first lines in each of the second comb-like structure of the first resonator 301, the first comb-like structure of the second resonator 302, the second comb-like structure of the fourth resonator 304, and the first comb-like structure of the fifth resonator 305 is shortened and the number of first lines increases, it is possible to realize the same coupling coefficient as the coupling coefficient of the filter of FIG. 9 and to satisfy the above relation.

The frequency of the second harmonic of the entire resonator is essentially determined by a half of the electric length of the entire resonator, and the resonant frequency of the first and second comb-like structures are essentially determined by the electric length of the comb-like structure. The above relation is fully satisfied and therefore the resonant frequency of the comb-like structure can be higher than the frequency of the second harmonic of the entire resonator. Therefore, it is possible to suppress problems due to the spurious.

Figure 14:
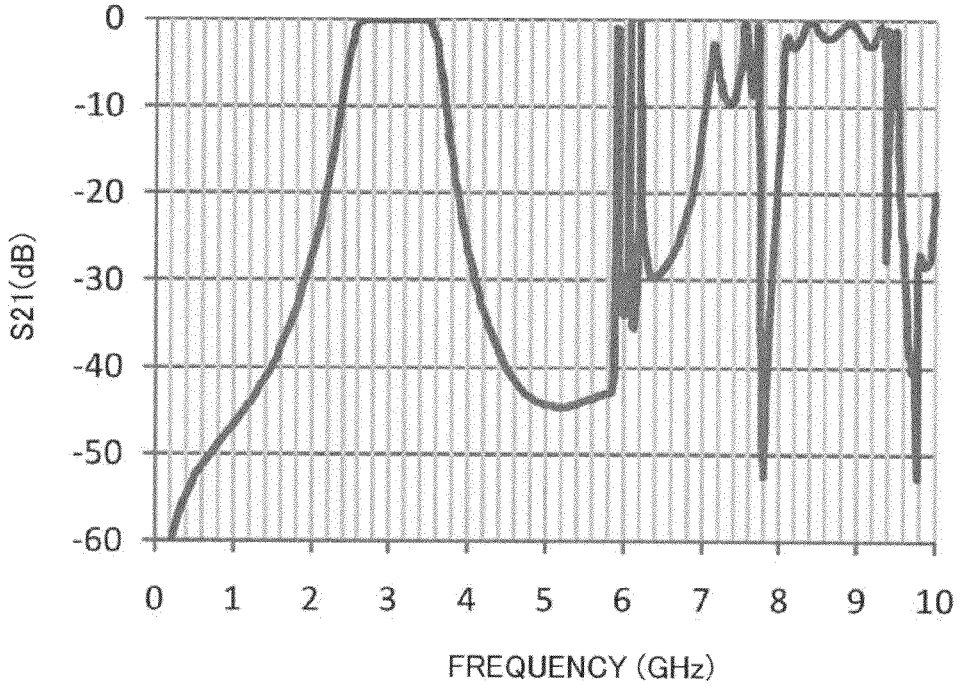
FIG. 14 is a diagram illustrating a frequency characteristic of the filter of FIG. 9.

FIG. 14 is a diagram illustrating a frequency characteristic of the filter of FIG. 9. Here, a pass band of the filter on design is from 2.7 GHz to 3.4 GHz. As can be seen from FIG. 14, in the filter of FIG. 9, a peak appearing in the vicinity of 6 GHz is lower than the resonant frequency of the second harmonic of the entire resonator appearing in 7 GHz to 9.5 GHz.

Figure 15:
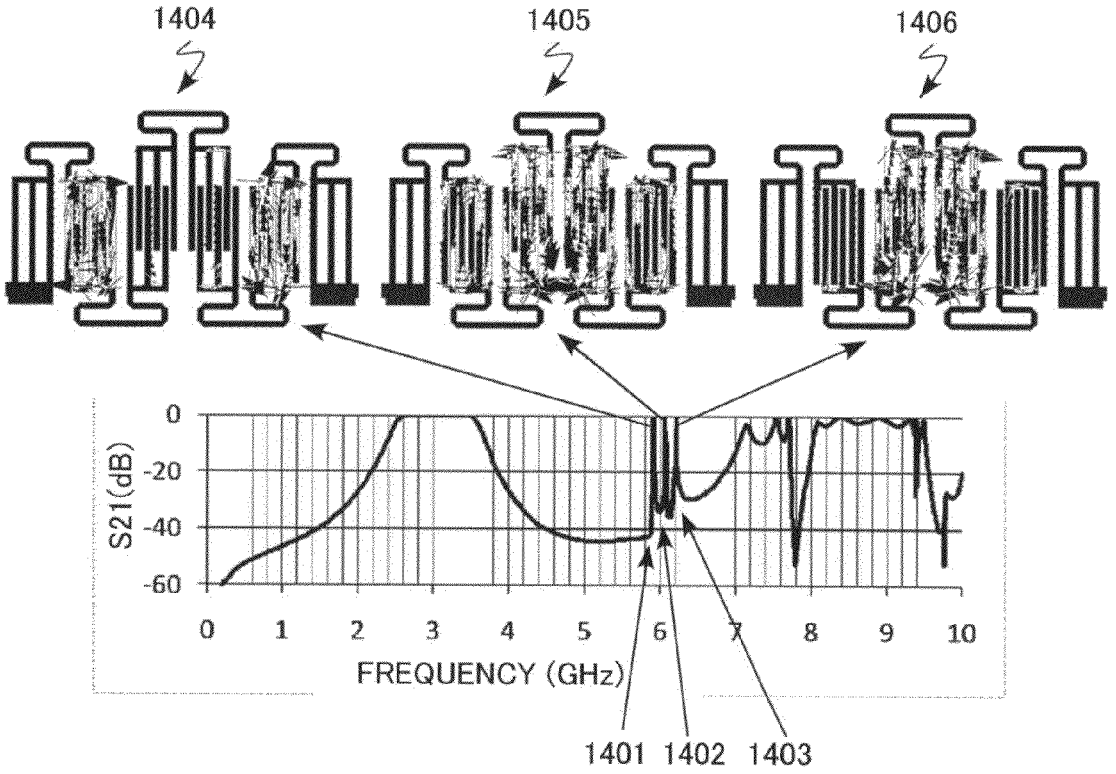
FIG. 15 is an explanatory diagram of the frequency characteristic of FIG. 14.

FIG. 15 is an explanatory diagram of the frequency characteristic of FIG. 14. FIG. 15 illustrates results of current distribution analysis by the electromagnetic field simulation of the filter of FIG. 9. From the results of this analysis, the current distribution at three peaks of 1401, 1402, and 1403 appearing in the vicinity of 6 GHz in FIG. 14 is as shown in 1404, 1405, and 1406, respectively. Therefore, it has been clarified that these peaks are derived from the resonance of the comb-like structure of the resonator.

Figure 16:
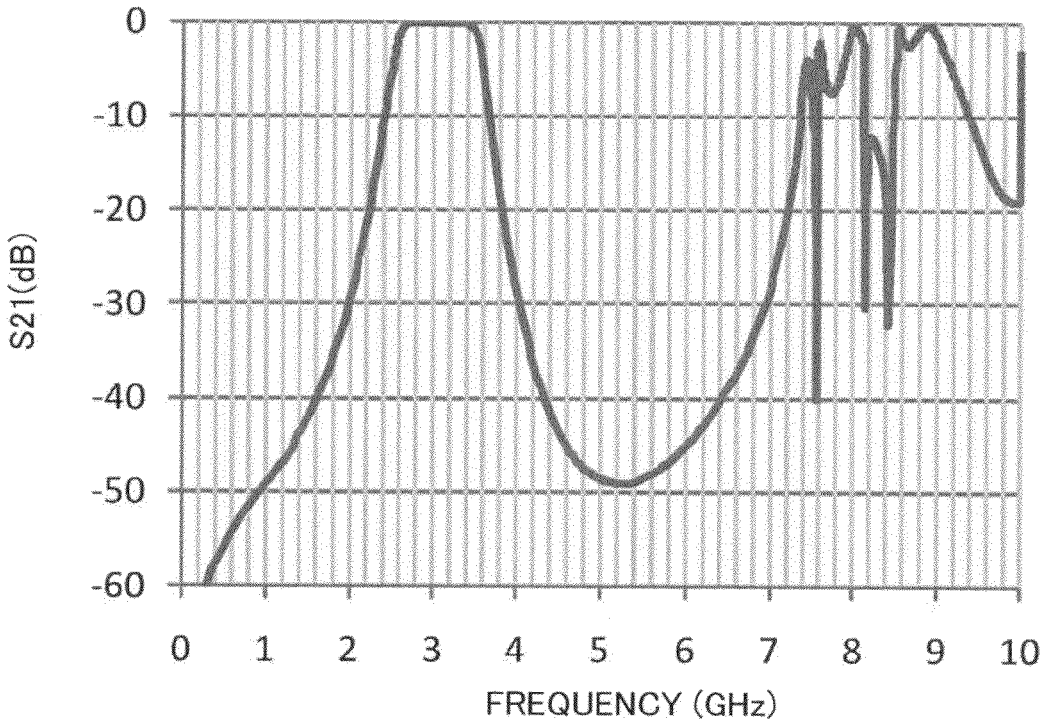
FIG. 16 is a diagram illustrating a frequency characteristic of the filter of FIG. 12.

FIG. 16 is a diagram illustrating a frequency characteristic of the filter of FIG. 12. In FIG. 12, as described above, the filter is configured such that the resonant frequency of the first or the second comb-like structure of the resonator is higher than the frequency of the second harmonic of the resonator. For this reason, a peak derived from the resonance of the comb-like structure of the resonator is higher than the resonant frequency of the second harmonic of the entire resonator appearing in 7 GHz to 9.5 GHz. Therefore, in FIG. 16, the spurious does not occur between the second harmonic and the fundamental frequency of the resonator. Therefore, it is possible to suppress problems due to the spurious.

Further, as illustrated in FIG. 12, the first comb-like structure and the second comb-like structure have preferably a different shape from each other, in any of the resonators constituting the filter. Thus, it is possible to change individually each of the coupling coefficients between a predetermined resonator and both resonators adjacent thereto.

Further, as illustrated in FIG. 12, the resonator is preferably asymmetrical shape with respect to a virtual straight line which is provided in parallel with the extending direction of the first lines at an intermediate position between the first comb-like structure and the second comb-like structure, in the resonator having the first comb-like structure and the second comb-like structure of the different shape among any of the resonators constituting the filter. For example, in FIG. 12, the length of the connection line is different in the right and left other than the resonator 303 and each of the resonators is asymmetrical with respect to the virtual straight line described above. Thus, even when the first comb-like structure and the second comb-like structure, which constitute the resonator, are different in shape, the current distribution can be symmetric to suppress the radiation loss.

According to the filter of the fourth embodiment, it is possible to realize the broadband band-pass filter by increasing the coupling coefficient between the resonators while implementing the sufficient unloaded Q value and the characteristic of second harmonic. Further, it is possible to sufficiently suppress the spurious due to the comb-like structure in order to enhance the coupling coefficient.

In the embodiments, the number of resonators constituting the filter is five as an example, but is not limited thereto.

Further, for example, the coupling between the input/output lines and the resonator is performed by the direct connection and is in the interlaced arrangement of the comb-like structure, but is not limited thereto. In addition, the input/output lines are not always necessary to be coupled to the open end of the resonator. This is useful to reduce the coupling coefficient with the external circuit.

While certain embodiments have been described, these embodiments have been presented by way of example only, and are not intended to limit the scope of the inventions. Indeed, the filter or resonator described herein may be embodied in a variety of other forms; furthermore, various omissions, substitutions and changes in the form of the devices and methods described herein may be made without departing from the spirit of the inventions. The accompanying claims and their equivalents are intended to cover such forms or modifications as would fall within the scope and spirit of the inventions.

What is claimed is:

1. A filter having a microstrip line structure, comprising:

n (n is a natural number larger than or equal to three) resonators arranged from a first resonator to n-th resonator;

an input line coupled to the first resonator; and an output line coupled to an n-th resonator, wherein each of the n resonators includes a first comb structure, a second comb structure, and a connection line connecting the first comb structure and the second comb structure to each other, each of the first and second comb structures having a plurality of first lines extending substantially parallel to each other and a second line connected to one ends of each of the first lines, the first lines of the first comb structure and the first lines of the second comb structure are arranged so as to be substantially parallel to each other, the connection line includes bending portions, and the connection line is connected to the second line of each of the first comb structure and the second line of the second comb structure, a second comb structure of a k ($1 \leq k \leq n-2$)-th resonator and a first comb structure of a (k+1)-th resonator are arranged so as to have an interlaced arrangement, and a second comb structure of the (k+1)-th resonator and a first comb structure of a (k+2)-th resonator are arranged so as to have an interlaced arrangement.

2. The filter according to claim 1, wherein a current distribution of the first comb structure and a current distribution of the second comb structure have an opposite phase at a resonance state, in at least one of the n resonators.

3. The filter according to claim 1, wherein a width of the connection line is narrower than a width of the first or second comb structure in a direction vertical to an extending direction of the first lines, in at least one of the n resonators.

4. The filter according to claim 1, wherein a resonant frequency of the first or second comb structure in at least one of the n resonators is higher than a frequency of a second harmonic of the resonator.

5. The filter according to claim 1, wherein an electric length of the first or second comb structure in at least one of the n resonators is equal to or less than a half of an electric length of the entire resonator.

6. The filter according to claim 1, wherein when the number of first lines of any one of the first or second comb structure is m (m is a natural number of two or more), a physical length of the first lines is L, and a physical length in an extending direction of the first lines of the resonator is Y, in at least one of the n resonators, a relation of $(2m-1)\times L \geq Y$ is satisfied.

7. The filter according to claim 1, wherein the first comb structure and the second comb structure have a different shape from each other in at least one of the n resonators.

8. The filter according to claim 7, wherein the resonator is asymmetrical with respect to a virtual straight line that is provided in parallel with an extending direction of the first lines at an intermediate position between the first comb structure and the second comb structure, in the resonator having the first comb structure and the second comb structure of the different shape.

9. The filter according to claim 1, wherein the input line is directly connected to the first comb structure of the first resonator, and the output line is directly connected to the second comb structure of the n-th resonator.

10. The filter according to claim 9, wherein a line width of the input line is changed in a vicinity of a connection portion with the first comb structure, and a line width of the output line is changed in a vicinity of a connection portion with the second comb structure.

11. The filter according to claim 1, wherein tips of the input line and the output line are provided with a comb structure, the comb structure of the input line and the first comb structure of the first resonator are arranged so as to have an interlaced arrangement, and the comb structure of the output line and the second comb structure of the n-th resonator are arranged so as to have an interlaced arrangement.

12. The filter according to claim 1, wherein a conductor material of the microstrip line structure is a superconducting material.

13. A resonator having a microstrip line structure, comprising:

a first comb structure;

a second comb structure; and a connection line connecting the first comb structure and the second comb structure to each other, wherein each of the first and second comb structures having a plurality of first lines that extend substantially parallel to each other and a second line connected to one ends of each of the first lines, the first lines of the first comb structure and the first lines of the second comb structure are arranged so as to be substantially parallel to each other, the connection line includes bending portions, and the connection line is connected to the second line of the first comb structure and the second line of the second comb structure, and a current distribution of the first comb structure and a current distribution of the second comb structure have an opposite phase at a resonance state.

14. The resonator according to claim 13, wherein a width of the connection line is narrower than a width of the first lines of the first or second comb structure in a direction vertical to an extending direction of the first lines.

15. The resonator according to claim 13, wherein a resonant frequency of the first or second comb structure is higher than a frequency of a second harmonic of the resonator.

16. The resonator according to claim 13, wherein an electric length of the first or second comb structure is equal to or less than a half of an electric length of the entire resonator.

17. The resonator according to claim 13, wherein the first comb structure and the second comb structure have a different shape from each other.

18. A filter comprising the resonator according to claim 13.

19. A resonator having a microstrip line structure, comprising:

a first comb structure;

a second comb structure; and a connection line connecting the first comb structure and the second comb structure to each other, wherein each of the first and second comb structures having a plurality of first lines that extend substantially parallel to each other and a second line connected to one ends of each of the first lines, the first lines of the first comb structure and the first lines of the second comb structure are arranged so as to be substantially parallel to each other, the connection line includes bending portions, and the connection line is connected to the second line of the first comb structure and the second line of the second comb structure, and when the number of first lines of any one of the first or second comb structure is m (m is a natural number of two or more), a physical length of the first lines is L, and a physical length in an extending direction of the first lines of the resonator is Y, a relation of $(2m-1)\times L \geq Y$ is satisfied.

* * * * *